US007540472B2

(12) United States Patent
Striebel et al.

(10) Patent No.: US 7,540,472 B2
(45) Date of Patent: Jun. 2, 2009

(54) RAIL AND RAMP SYSTEMS WITH ADJUSTABLE FITTINGS

(75) Inventors: Roman F. Striebel, Duxbury, MA (US); James J. Storrer, Foxboro, MA (US)

(73) Assignee: Suncor Stainless, Inc., Plymouth, MA (US)

( * ) Notice: Subject to any disclaimer, the term of this patent is extended or adjusted under 35 U.S.C. 154(b) by 0 days.

(21) Appl. No.: 11/746,943

(22) Filed: May 10, 2007

(65) Prior Publication Data

US 2008/0277640 A1 Nov. 13, 2008

(51) Int. Cl.
*E04H 17/00* (2006.01)

(52) U.S. Cl. ..... 256/67; 256/65.07; 256/65.08; 256/65.15

(58) Field of Classification Search ... 256/65.01–65.03, 256/65.05, 65.07, 65.08, 65.11, 65.12, 65.15, 256/65.16, 67
See application file for complete search history.

(56) References Cited

U.S. PATENT DOCUMENTS

| | | | | | |
|---|---|---|---|---|---|
| 1,316,155 | A * | 9/1919 | Harrison et al. | ..... | 256/65.05 |
| 1,772,159 | A * | 8/1930 | Roth | ..... | 256/65.08 |
| 2,242,427 | A * | 5/1941 | Heanue | ..... | 256/65.08 |
| 2,427,723 | A * | 9/1947 | Hawkins et al. | ..... | 256/22 |
| 3,004,751 | A * | 10/1961 | Woodward | ..... | 256/67 |
| 3,484,827 | A * | 12/1969 | Hall | ..... | 256/59 |
| 4,150,907 | A * | 4/1979 | Thurnauer | ..... | 403/234 |
| 4,351,469 | A * | 9/1982 | Newman | ..... | 228/135 |
| 4,358,214 | A * | 11/1982 | Shull | ..... | 403/234 |
| 4,722,514 | A * | 2/1988 | Pettit | ..... | 256/50 |
| 4,767,232 | A * | 8/1988 | Francis | ..... | 403/91 |
| 5,404,682 | A * | 4/1995 | West | ..... | 52/165 |
| 5,437,433 | A * | 8/1995 | Rezek | ..... | 256/67 |
| 5,452,880 | A * | 9/1995 | Bailey | ..... | 256/67 |
| 5,746,533 | A * | 5/1998 | Schmidt | ..... | 403/102 |
| 6,257,799 | B1 * | 7/2001 | Ribe | ..... | 403/402 |
| 6,290,213 | B1 * | 9/2001 | Laird et al. | ..... | 256/65.05 |
| 6,565,069 | B2 * | 5/2003 | Morris | ..... | 256/73 |
| D485,619 | S * | 1/2004 | Hoefer | ..... | D25/38 |
| 6,736,373 | B2 * | 5/2004 | Greaves | ..... | 256/65.16 |
| 6,860,472 | B2 * | 3/2005 | Striebel et al. | ..... | 256/65.03 |
| 6,874,767 | B1 * | 4/2005 | Gibbs | ..... | 256/65.08 |
| 7,044,450 | B2 | 5/2006 | Striebel et al. | ..... | 256/65.16 |
| 2005/0056821 | A1 * | 3/2005 | Kerr | ..... | 256/22 |

* cited by examiner

*Primary Examiner*—Daniel P Stodola
*Assistant Examiner*—Joshua T Kennedy
(74) *Attorney, Agent, or Firm*—Burns & Levinson, LLP; Jacob N. Erlich, Esq.

(57) ABSTRACT

Modular railing and ramp systems having adjustable fittings to allow a multitude of rail configurations utilizing a series of mechanical connections.

9 Claims, 20 Drawing Sheets

RAIL AND RAMP SYSTEMS WITH ADJUSTABLE FITTINGS

FIELD OF THE INVENTION

This invention relates generally to railings, and more specifically, to modular rail systems for stairs and ramps.

BACKGROUND OF THE INVENTION

Metal railing systems, but more especially stainless steel railing systems, presently on the market usually require components to be welded together to form the required shapes and frames. This can only be achieved in a workshop environment and is very time consuming due to the required precision cutting, welding and polishing of the seams. Existing modular metal railing systems include connections that are either complicated, unsuitable for consumer installation or unsightly, making most of these systems only suitable for industrial or some commercial installations.

In addition, the biggest challenge faced by architects, builders and installers alike, are the construction of ramps and stairs, as those always require detailed design and time consuming manufacture in a workshop environment.

It is therefore, desirable to improve the ease of installation and construction of railings for decks, balconies, handicap access, and any other applications, especially ramps and stairs forming part of these varied installations.

It is similarly desirable to minimize the number of components required to cover virtually all variations encountered in the above applications, and to design said components in such a way as to enable installation by moderately skilled consumers with very simple hand tools, or by professional contractors in far shorter installations times, and with much more adaptability for unforeseen or unusual situations than possible presently.

Other desirable characteristics of railing systems include corrosion resistance, minimal maintenance and price competitiveness with respect to other railing materials.

SUMMARY OF THE INVENTION

The present invention provides a modular railing system that is easy to install and maintain, durable and compares favorably with respect to cost when compared to other systems available. Further the present invention permits use of either vertical spindles or balusters, or the use of virtually any horizontal cable or wire system on the market today, or the use of glass in sections, or covering all or most of the opening between the posts, as determined by architects and/or in accordance with any relevant building regulations. These advantages as well as further and other advantages of the present invention are achieved by embodiments of the invention described herein below.

The invention is based on commercially available stainless steel (or other material) tubing, which is connected into a railing, ramp or stairs, or into a framework by uniquely designed fittings, which allow all possible standard rail configurations.

The outer framework of the tubing is similar for virtually all applications, whether the infill is comprised of commercially available horizontal wire or cable systems, or employs spindles in a baluster system, or utilizes sheet glass or strips of glass. All these alternatives are deemed within the scope of the present invention; however the lower tube is optional for the horizontal cables and the sheet glass embodiment.

It is also a common requirement for steps to lead from or to a railing, and for these steps to either be in line or at right angles (either left or right) to the railing. All such possibilities are enabled by the railing system provided by the present invention, as are all possible angles of such steps either up or down, using identical fittings. The present invention overcomes the difficulties in connecting stair and ramp vertical posts with components that must follow the angle of the stairs or ramp, while preferably remaining parallel to each other, and still being able to carry various commercially available infill materials.

Another capability common in railing systems in accordance with the present invention is that all connections may be held together by mechanical, rather than welded, connections. These connections may be further secured by commercially available adhesives such as epoxies, yet the system relies on epoxy only to prevent rattles or vibration. The mechanical connections will hold safely even if the epoxy fails, has been badly applied, or is not used.

The present invention not only provides customizable handicap access to railing systems such as the modular system described herein, but also to railing systems employing vertical tubular supports, with a minimal number of modular components. Existing handicap rails, especially for commercial buildings, are typically welded together as units and custom-made for each application. The present invention provides the ability to adapt the vertical and horizontal parts of a railing to varying degrees of a ramp, while maintaining at all times the posts vertical orientation and the top, bottom of grab rail's parallel orientation with respect to the ramp slope.

The present invention further provides solutions for changing the direction of a rail in the horizontal plane, as is the case with octagon or other such shaped railings. It is also often desirable to connect stairs or ramp railings to vertical posts in such a way that the top rail is continuous as much as possible, even though the height of the stair or ramp railing differs with the height of the horizontal railing.

During installation it is further desirable that posts can be mounted and secured first to a suitable surface, and that the infill material or top and bottom rails be connected later. Existing systems often require rails to be built in individual sections, which is more difficult to line up correctly and more time consuming.

DETAILED DESCRIPTION OF THE INVENTIONS

Figure 1A:
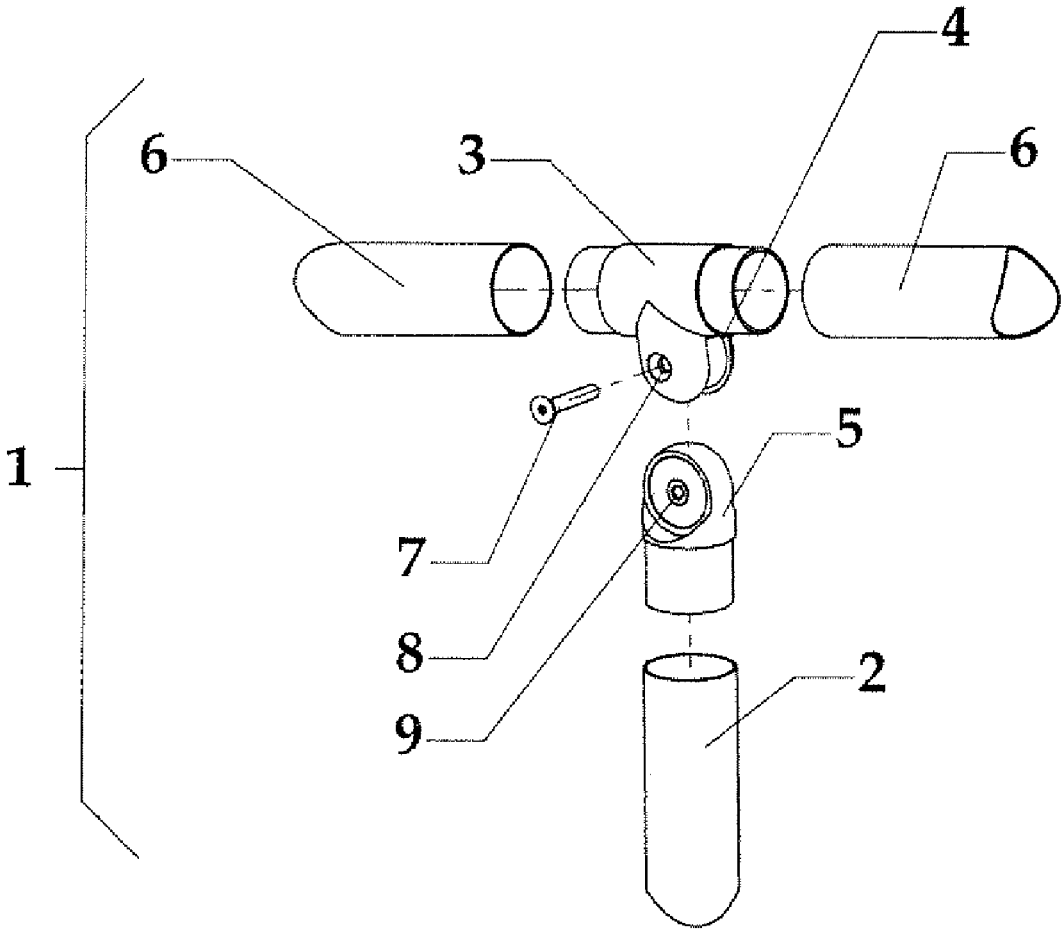
FIG. 1*a* is an exploded pictorial view of a modular, angularly adjustable top rail fitting in accordance with the present invention.
Figure 1B:
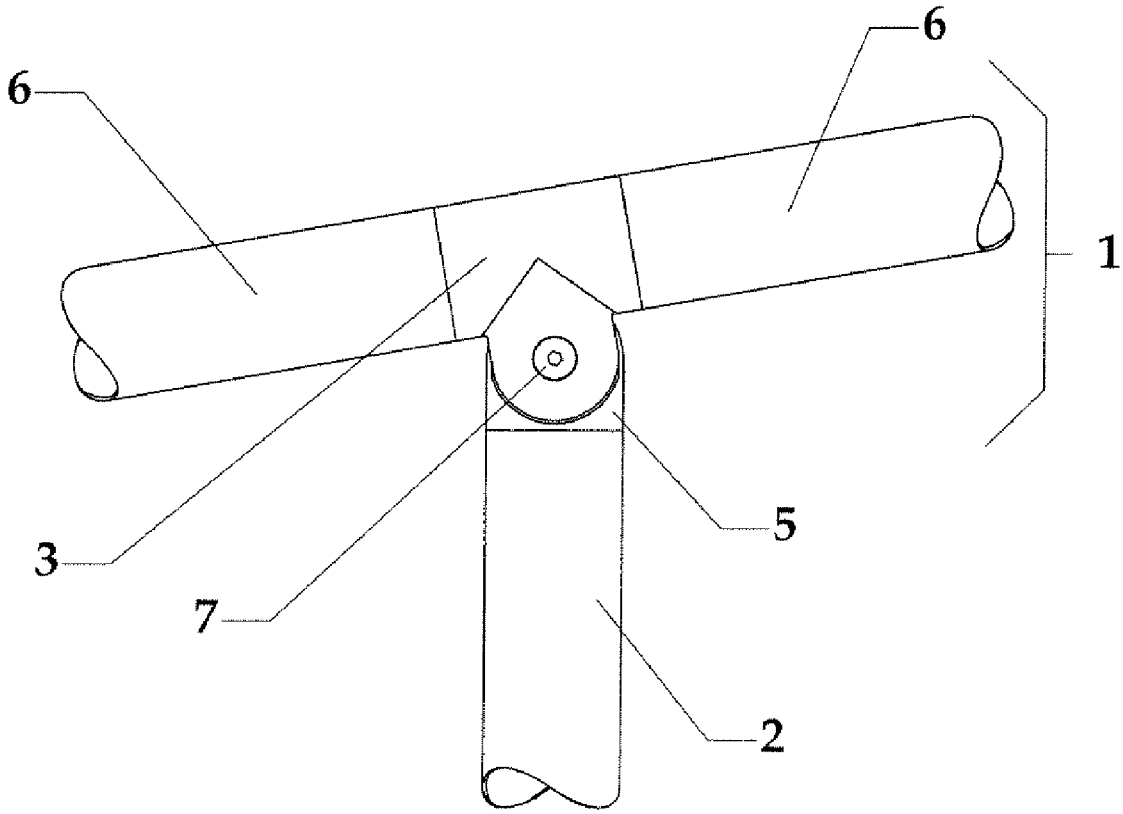
FIG. 1*b* is a detailed pictorial view of a modular, angularly adjustable top rail fitting in accordance with the present invention.

FIGS. 1*a* and 1*b* illustrate a modular, angularly adjustable top rail fitting 1, for use on ramps such as, but not limited to, handicap access ramps, which is vertically mounted upon a vertical post or tube 2. Adjustment is effected by use of a "T" fitting 3 incorporating a clevis 4 shaped so as to receive an adjustable male rail adaptor 5. The clevis is recessed into the "T" fitting in such a way as to strengthen the "T" and to place the fulcrum as close a possible to the top rail 6. After orienting the top rail to the desired slope, which can be from 0 degrees (horizontal) to 50 degrees (as typically used on stairways), a commercially available (or modified for length) connection bolt 7 is tightened, thereby locking the adjustable "T" assembly in place. Since it is desirable not to have the bolt hole 8 being drilled through to the other side, a feature of this invention is that hole 8 is not internally threaded, but hole 9 in the male rail adaptor 5 has been threaded to suit bolt 7. When the bolt 7 is tightened, the main rail adaptor 5 is pulled against the inside of the clevis 4, which locks the assembly 1 into the desired slope.

Figure 2A:
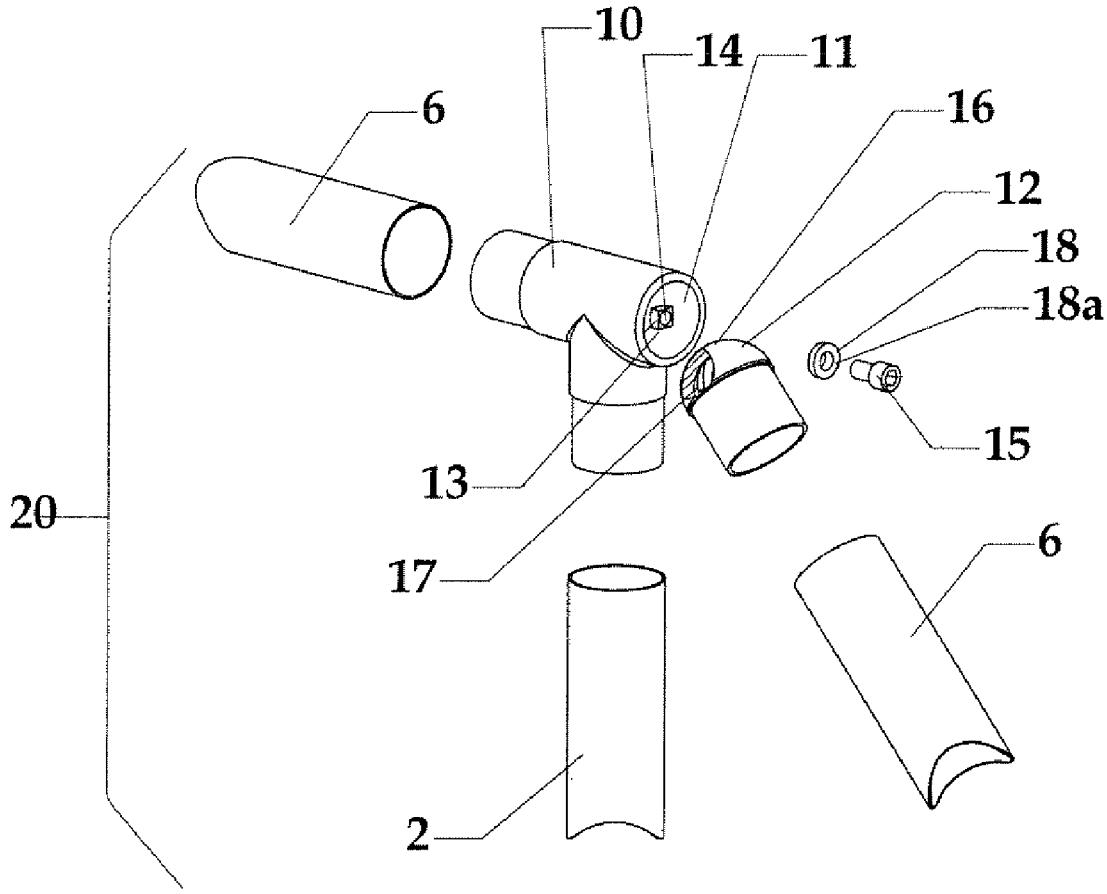
FIG. 2*a* is an exploded, pictorial view of a modular, angularly adjustable "T" rail fitting in accordance with the present invention.
Figure 2B:
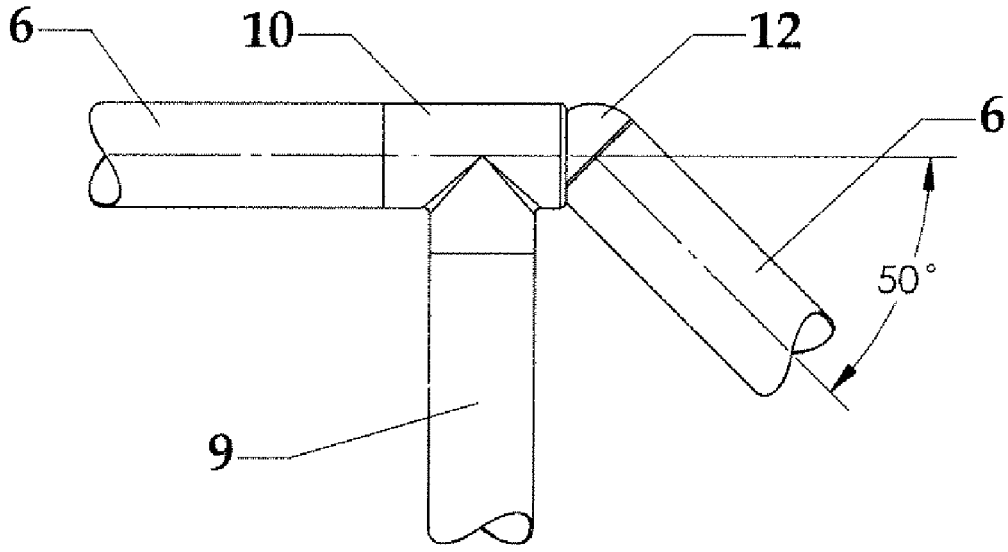
FIG. 2*b* is a pictorial view of a modular, angularly adjustable "T" rail fitting in accordance with the present invention.
Figure 2C:
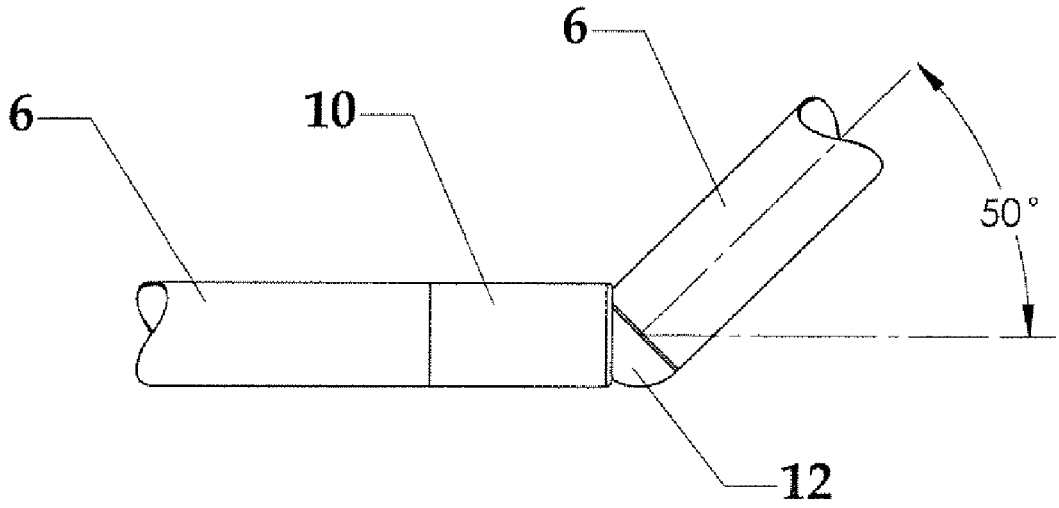
FIG. 2*c* is a pictorial view of a modular, angularly adjustable "T" rail fitting in accordance with the present invention.
Figure 2D:
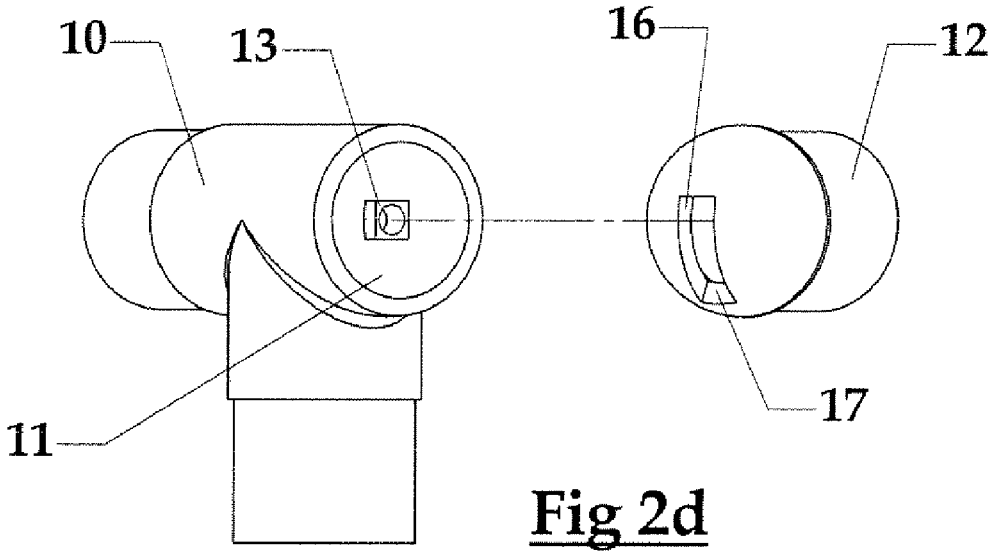
FIG. 2*d* is an extended, pictorial view of a modular, angularly adjustable "T" rail fitting in accordance with the present invention.
Figure 2E:
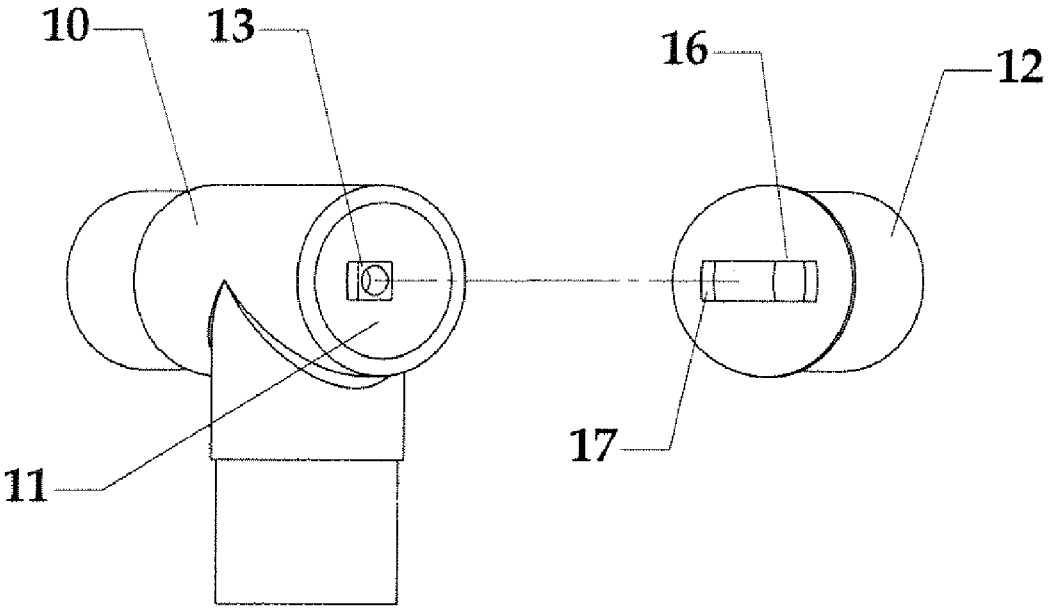
FIG. 2*e* is an exploded, pictorial view of a modular, angularly adjustable "T" rail fitting in accordance with the present invention.
Figure 2F:
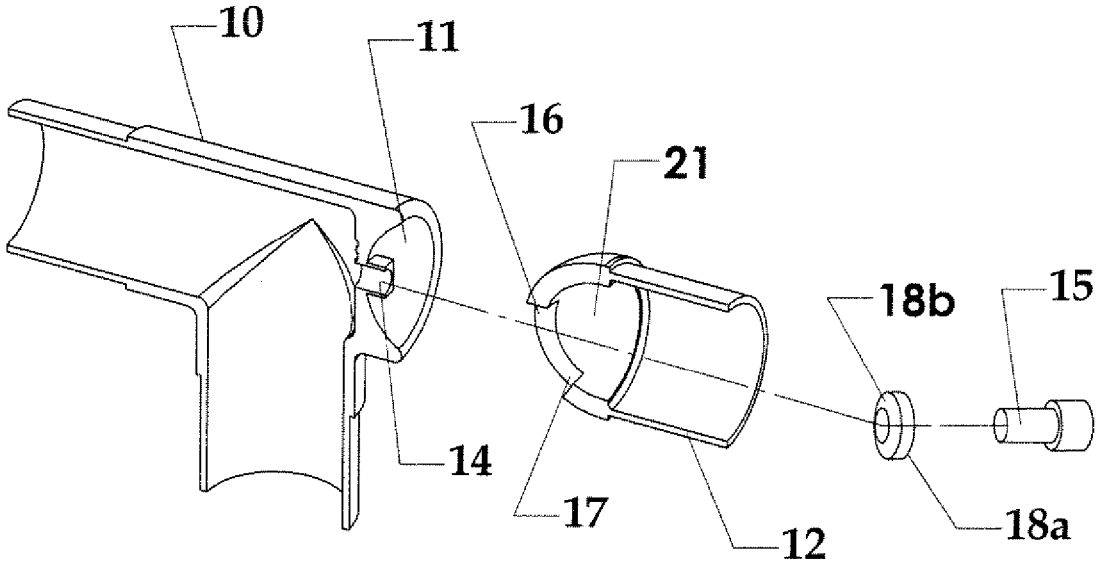
FIG. 2*f* is a broken, exploded, pictorial view of a modular, angularly adjustable "T" rail fitting in accordance with the present invention.

FIGS. 2*a*, 2*b*, 2*c*, 2*d*, 2*e* and 2*f* illustrate a modular, angularly adjustable transition "T" rail fitting 20, for use as a transition between a horizontal rail and a handicap access ramp or stairs, which is vertically mounted upon a vertical post or tube 2. Adjustment is effected by use of a "T" fitting 10 incorporating a dish 11 that is shaped so as to receive an adjustable slotted rail adaptor 12. The preferably concave spherical surface of the dish 11 has at its center a square key 13 that contains a threaded bore 14 capable to receiving a suitable bolt 15 that can tighten the adjustable slotted rail adaptor 12 to the "T" fitting 10. Key 13 may be rectangular shaped as well if only one type of movement of rail adaptive 12 is desired. The adjustable slotted rail adaptor contains a slot opening 16 extending from the center of the fitting to one side 17 and dimensioned in width to fit without side or turning movement onto the key 13. To facilitate a proper seat of bolt 15, a special washer 18 is provided that has a flat top 18*a* and a convex spherical underside 18*b*, designed to match the inside spherical shape 21 of the slotted rail adaptor 12 which is externally, convexly, spherically-shaped. The key 13 is dimensional so as to enable it to be positioned within slot opening 16 for a number of positions such as, but not limited to the horizontal or vertical position and thus effecting the movement or position of rail 6 as shown in FIGS. 2*d* and 2*e*. There may be other shapes for key 13, such as, but not limited thereto, polygons or the like capable of matingly engaging a slot of like female configuration enabling further positioning of the rails with respect to one another. Further, the convex/concave portions and related mechanisms can be reversed such that fitting 10 has a convex outer surface and fitting 12 has a convex outer surface. If the reversed position is utilized the bolt 15 and washer 18 would be associated with fitting 10 instead of fitting 12.

In the described preferred embodiment 2c of the adjustable transition "T" rail fitting 20, the adjustable slotted rail adaptor 12 can be set to, and maintain, precise horizontal angles, while providing support against an unintended movement up or down, or unintended turns or twist vertically. The square shape of the key 13, taken together with the slot opening 16, allows only movement in the intended direction, typically up to 50%, and provides a barrier to any direction perpendicular thereto or a different turning. Thus angular adjustable transition "T" rail fitting 20 can be used to transition from one direction of a straight railing to a direction left or right, typically up to 50 degrees, as desired, thus forming deck railings with various angles.

By repositioning the slot 90 degrees or 270 degrees, as illustrated in embodiment 2b, the square shape of the key 13 however also allows the slot opening to be perpendicular 15 (vertical) to the described horizontal angles up to 50% up or down (as typically used on stairways), and in that embodiment a precise vertical adjustment is possible, while providing support against unintended movements side to side (horizontally) or turning. The angular adjustable transition "T" rail fitting 20 therefore can be used to transition from ramps to horizontal sections, and back again to ramp sections, on a handicap access system, and can also be used to transition from a horizontal railing vertically down to stairs and then back again to a horizontal railing.

Figure 3A:
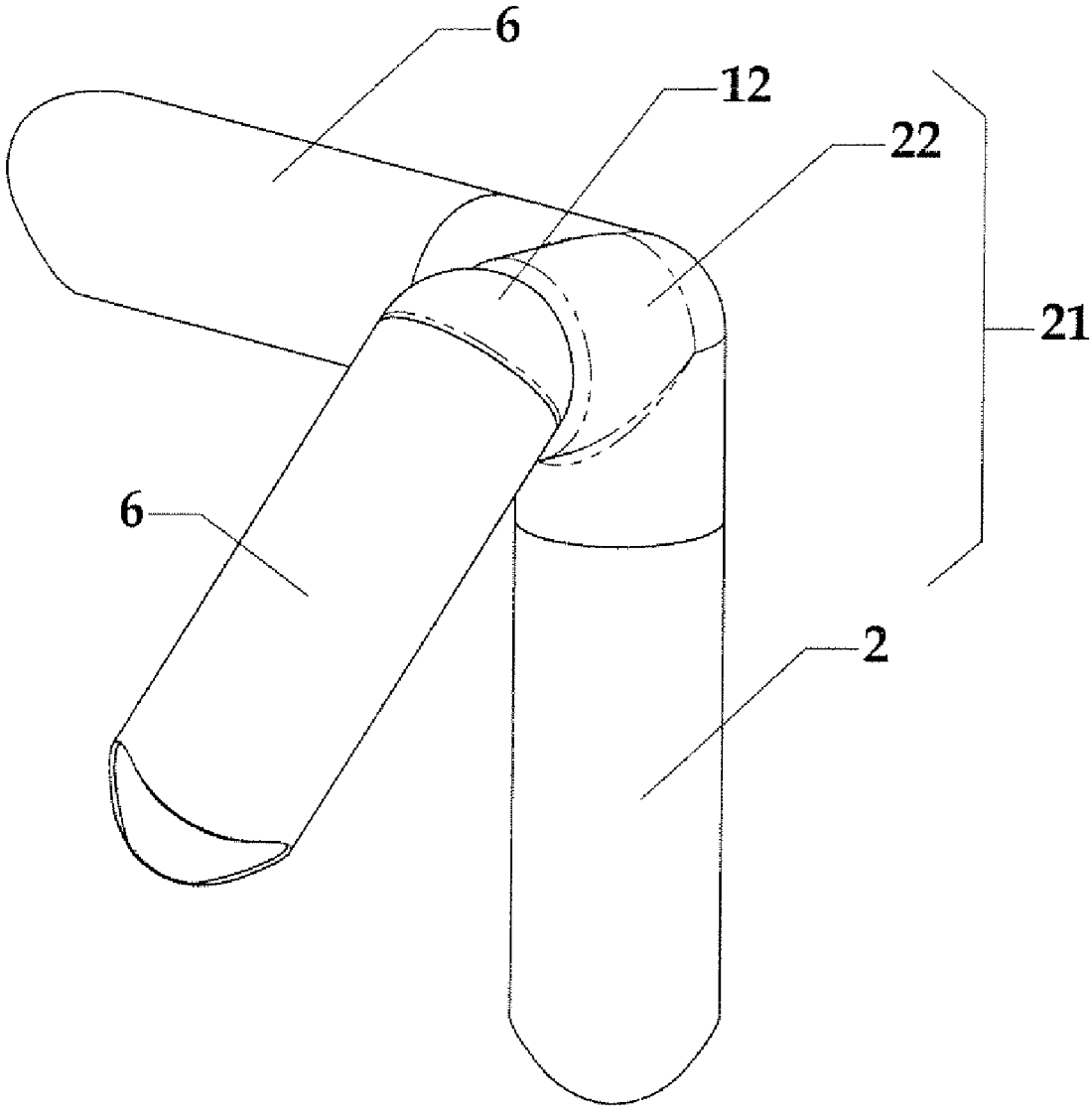
FIG. 3*a* is a pictorial view of a modular adjustable top corner fitting in accordance with the present invention.
Figure 3B:
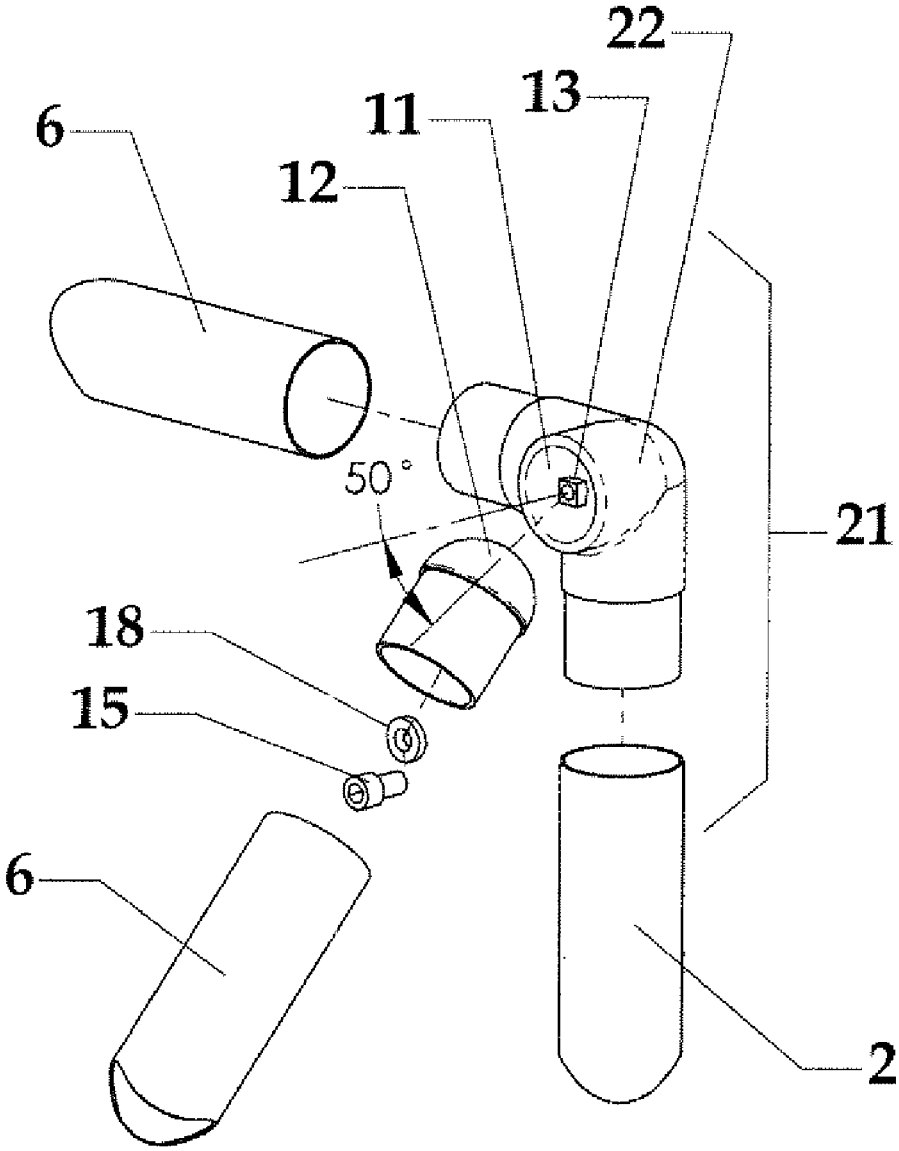
FIG. 3*b* is a pictorial view of a modular adjustable top corner fitting in accordance with the present invention.

FIGS. 3*a* and 3*b* illustrate a further embodiment of the invention as a modular, angular adjustable top corner fitting 21, for use as a transition between a horizontal rail corner and a handicap access ramp or stairs, which is vertically mounted upon a vertical corner post or tube 2. Adjustments can be made to the adjustable corner fitting body 22 in the same manner as described above up to 50 degrees, either in the horizontal plane left or right, or the vertical place up and down.

Figure 4A:
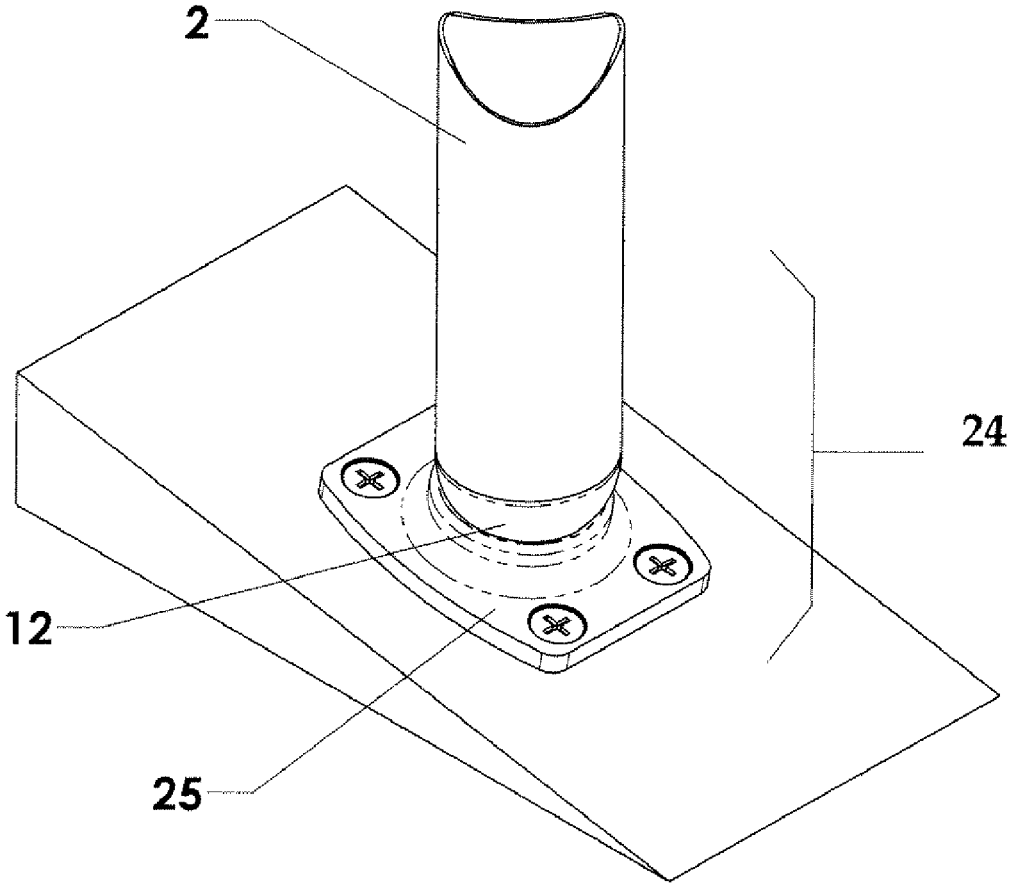
FIG. 4*a* is a pictorial view of a modular adjustable base fitting in accordance with the present invention.
Figure 4B:
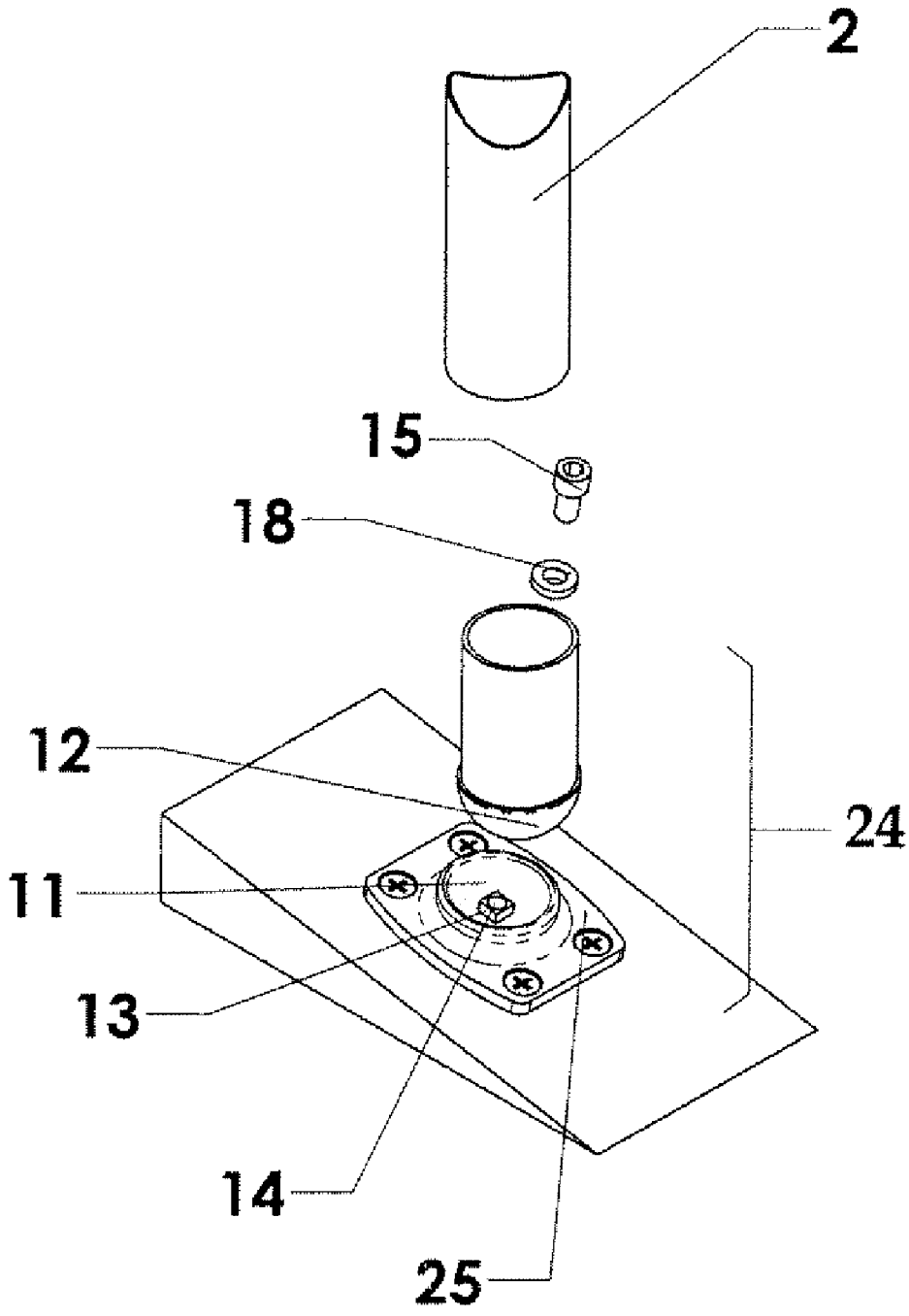
FIG. 4*b* is an exploded, pictorial view of a modular adjustable base fitting in accordance with the present invention.
Figure 4C:
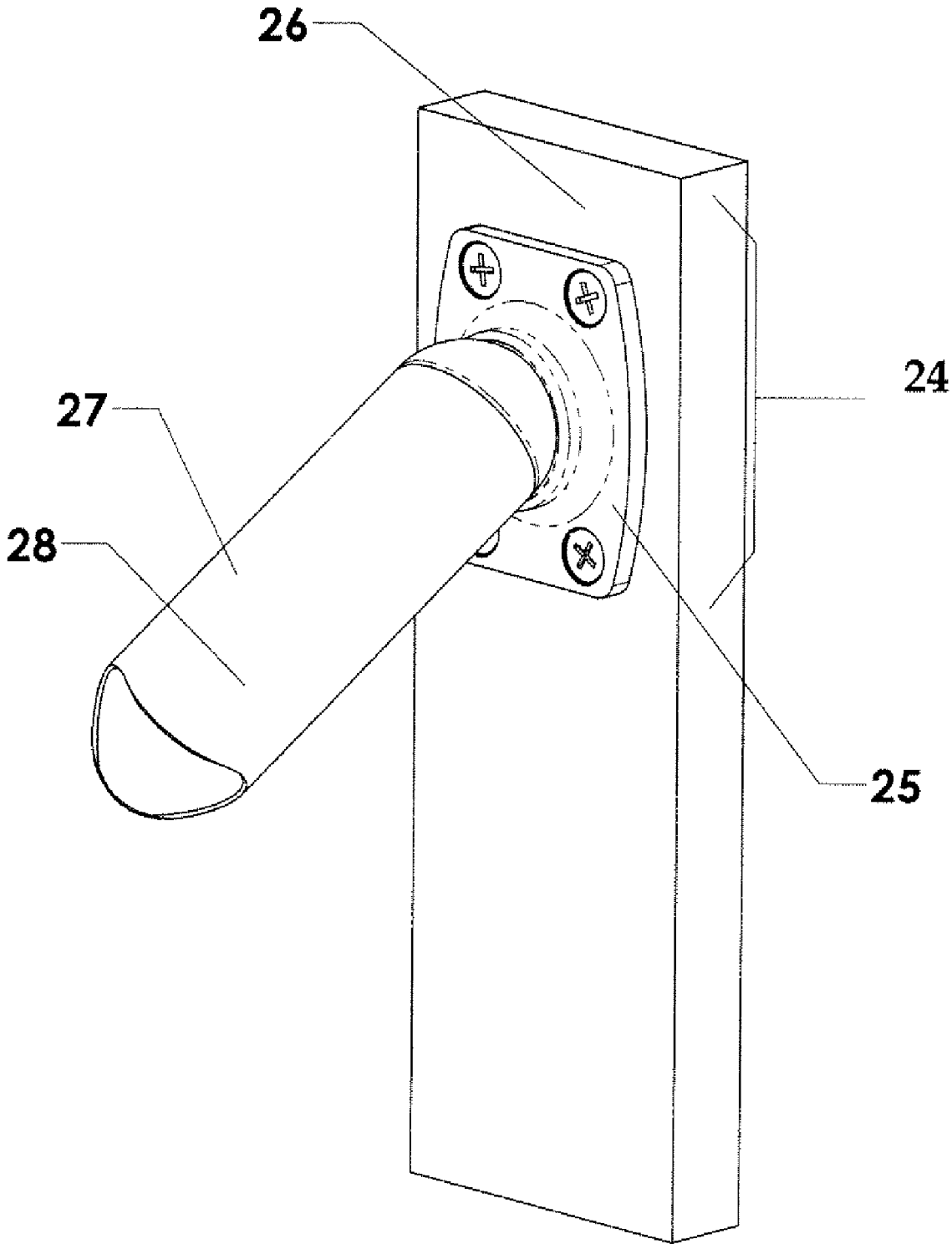
FIG. 4*c* is a pictorial of a modular adjustable base Fitting in accordance with the present invention.
Figure 4D:
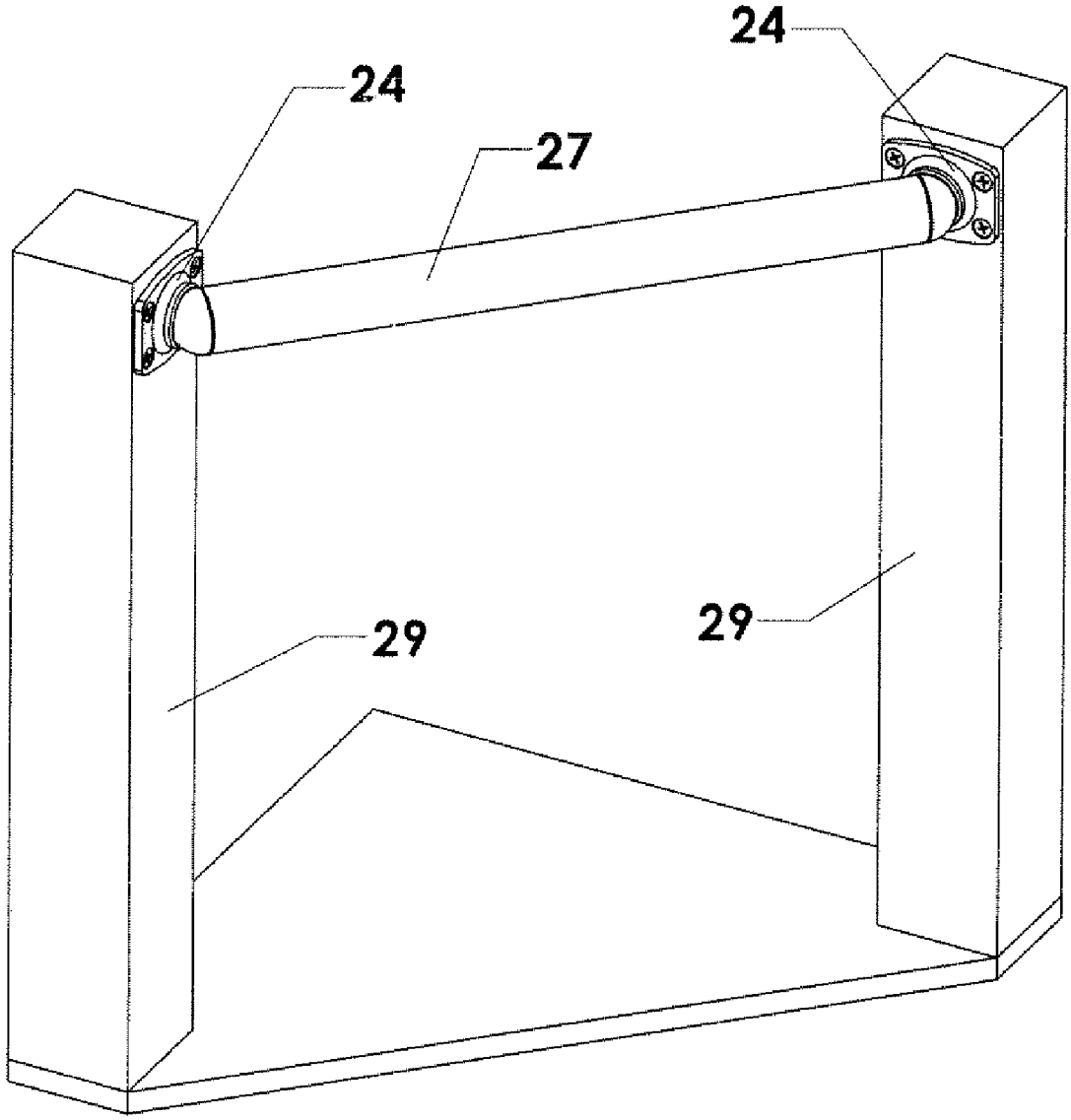
FIG. 4*d* is a pictorial view of a modular adjustable base fitting in accordance with the present invention.

FIGS. 4*a*, 4*b*, 4*c* and 4*d* illustrate yet a further embodiment of the invention as a modular adjustable base fitting 24. In this embodiment the base 25 will follow the slope of the ramp, while the adjustable slotted rail adaptor 12 can be positioned vertically. Once the precise vertical position has been reached, the bolt 15 is tightened on the washer 18, thus locking the adjustable base fitting, before attaching the vertical post or tube post 2. In a further embodiment the modular adjustable base fitting 24 can be mounted on a flat vertical surface 26, for instance for use as a rail end connected to the side of a building, thus allowing the top 27 or bottom rail 28 to connect to such surface at an adjustable angle, either in the horizontal or the vertical plane. When mounted to posts 28 for example, as illustrated in FIG. 4*d*, the modular adjustable base fitting 24 can also be used to change direction, either left or right, of a railing contained between a plurality of posts 29.

Although the invention has been described with respect to various embodiments, it should be realized this invention is also capable of a wide variety of further and other embodiments. For instance the invention could be used alone or in combination with other fittings to attach a tube at any desired angle to another tube of fitting. The vertical or horizontal support tubes to which the invention is attached could be solid, cylindrical or rectangular posts, unlike the tubing employed in the present invention.

FIGS. 5*a*, 5*b*, 5*c*, 5*d*, 5*e* and 5*f* illustrate a modular connecting set 30 for use on ramps or stairs. The set is made up of different parts, depending on the application, such as to a line post or to an end post of a stair or ramp system. A uniquely shaped toggle bar 31 contains two enlarged identical ends 32, connected by a significantly smaller connecting bar 33, preferably with a rectangular cross section 34. At substantially the center of the bar 33 is a suitably threaded hole 35, and in line with the longitudinal axis of the bar 34 two further, preferably identically threaded holes 36 are provided in the enlarged ends 32. At each end a rail adaptor 37 is provided with a slot 38 from the underside 39, which is just wide enough to accommodate the enlarged identical ends 32. Preferably the shape of the enlarged ends follows the exact outline of the end of the rail adaptor 37, so that the enlarged end 32, when inserted into the slot 38 present a complete form, for example a sphere in the preferred embodiment.

Figure 5A:
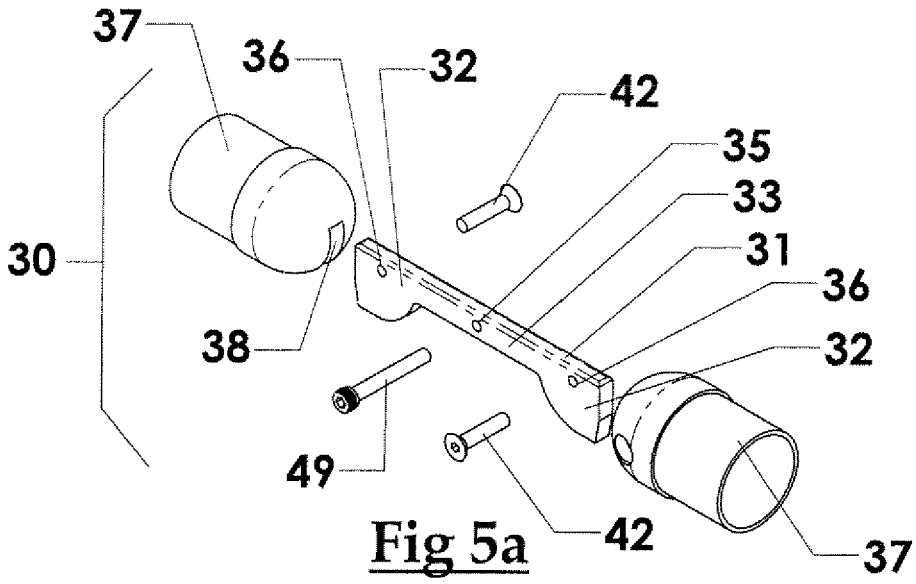
FIG. 5*a* is an exploded, pictorial of a modular connecting set in accordance with the present invention.
Figure 5B:
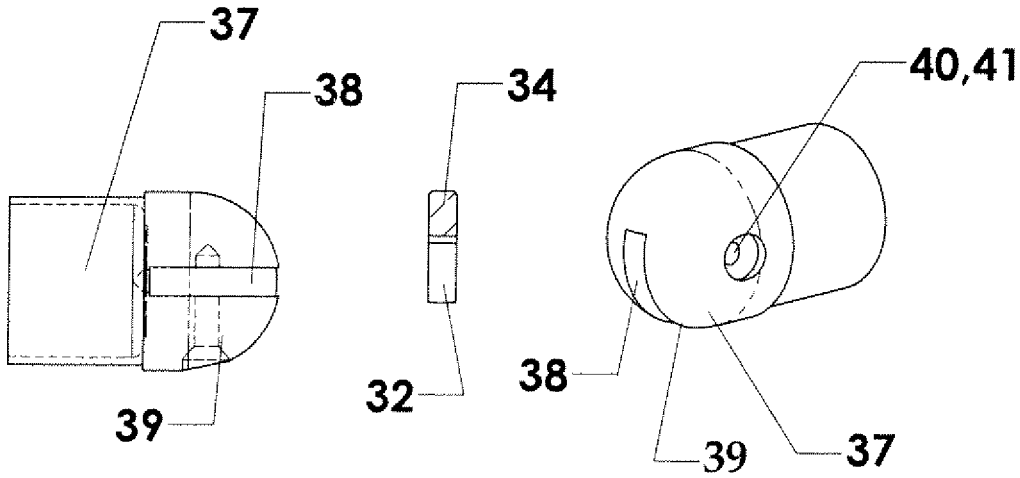
FIG. 5*b* is an exploded detailed pictorial of the assembly of the modular connecting set.
Figure 5C:
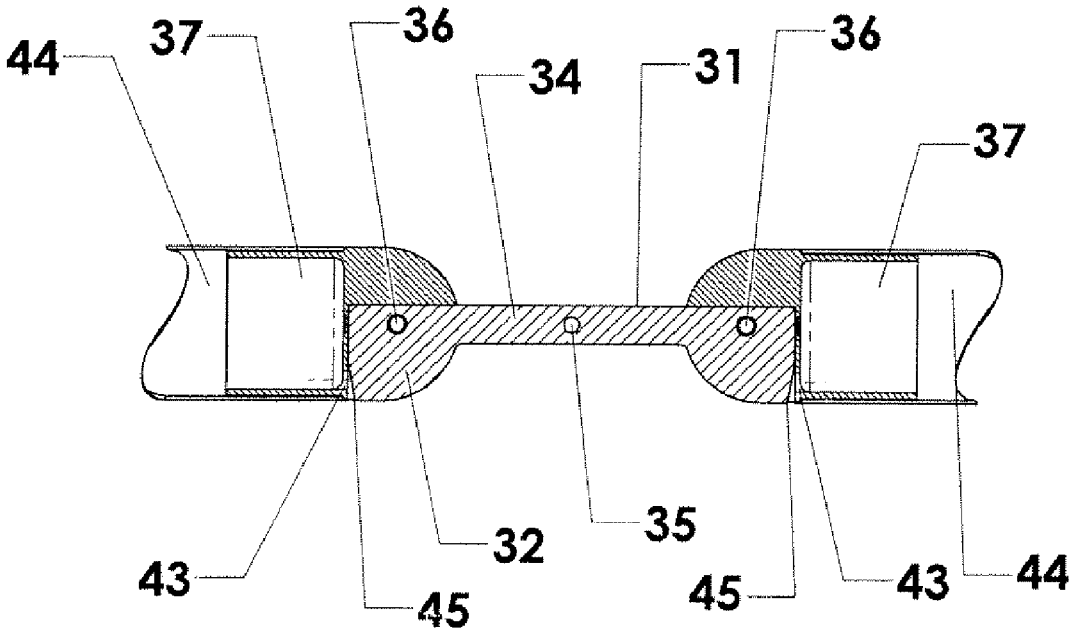
FIG. 5*c* is a pictorial view of the assembly of the modular connecting set.

As clearly shown in FIGS. 5*a* and 5*b*, a recess 40 and a cylindrical, unthreaded through hole 41 are provided on one side only of the rail adaptor 37, through which a suitable bolt 42 can be inserted and tightened into the threaded hole 36. By tightening such bolt 42, the enlarged end 32 is pressed against the side of the slot 38 thus completely locking the enlarged end 32 and the rail adaptor 36 together without possible movement. This embodiment makes it unnecessary to have hole going all the way through the adaptor 37 for much improved appearance and function. In addition, it should be realized that end 32 may be adjustably rotated within slot 38 of rail adaptor 37.

The inside of the rail adaptor 37 has a drain hole 43 that connect with the slot 38 thus allowing any water that has penetrated the tubing 44 to drain out through the slightly recessed vertical face 45 of the identical ends 32.

Figure 5D:
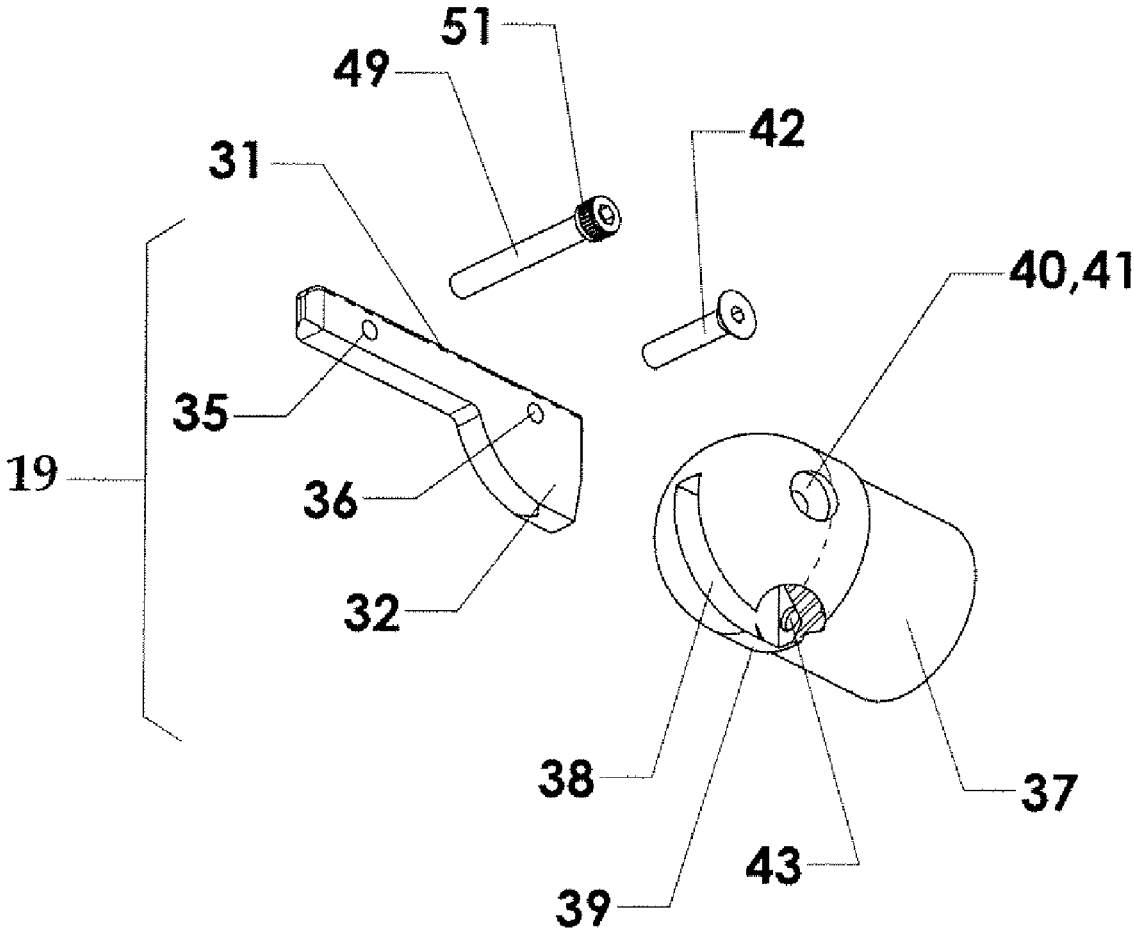
FIG. 5*d* is an exploded, pictorial view of a second toggle bar assembly of the modular connecting set in accordance with the present invention.
Figure 5E:
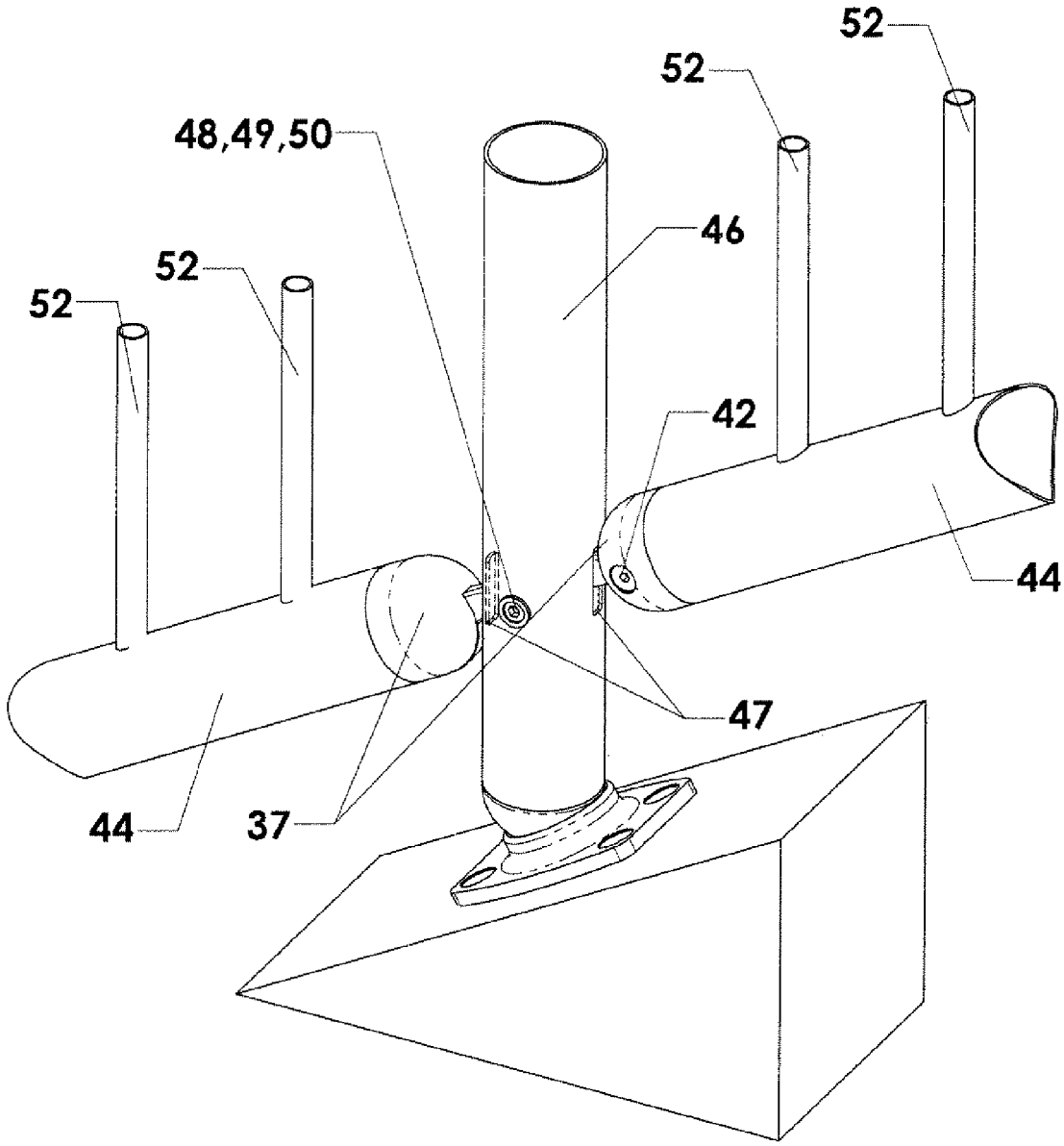
FIG. 5*e* is a pictorial view of the second toggle bar assembly used in accordance with the system described herein.

As illustrated in FIG. 5*e*, a vertical post 46 is provided with two suitable slots 47, opposite each other and in line with the stair or ramp railing. Perpendicular to the slots two commercially available hollow rivets 48 are inserted into the vertical post 46. Once the posts have been attached to their base, the special toggle bar 31 is inserted through both slots 47 in such a way as to align the threaded hole 35 with the hollow rivets 48. A suitable bolt 49 is then inserted into one of the hollow rivets 48 and threaded through hole 35 until the end of the bolt is fully contained inside the opposing hollow rivet 48. By tightening such bolt 49 the special toggle bar 31 is pressed against one side of the two slots 47, thus locking the toggle bar securely in the desired slope angle and providing a fulcrum in the exact center of the vertical post 46. In the preferred embodiment two suitable hollow rivets 48 are provided to give extra stability to the through bolt 49, although the invention will also work with just one hollow rivet 48 or with a variation of similar features. For a smooth and flush appearance the hollow rivet 48 should be provided with a suitable recess 50, which is dimensioned to contain the head 51 of the bolt 49 as completely as possible.

FIG. 5*d* shows a further embodiment of the invention, where the specially shaped toggle bar 31 contains only one enlarged end 32. This embodiment is suitable for the last vertical post either at the top or bottom of the stairs or the ramp, thus eliminating one of the slots 47. There is also the option of adding a suitably shaped internal support part into post 2 to strengthen the whole assembly against warping.

Figure 5F:
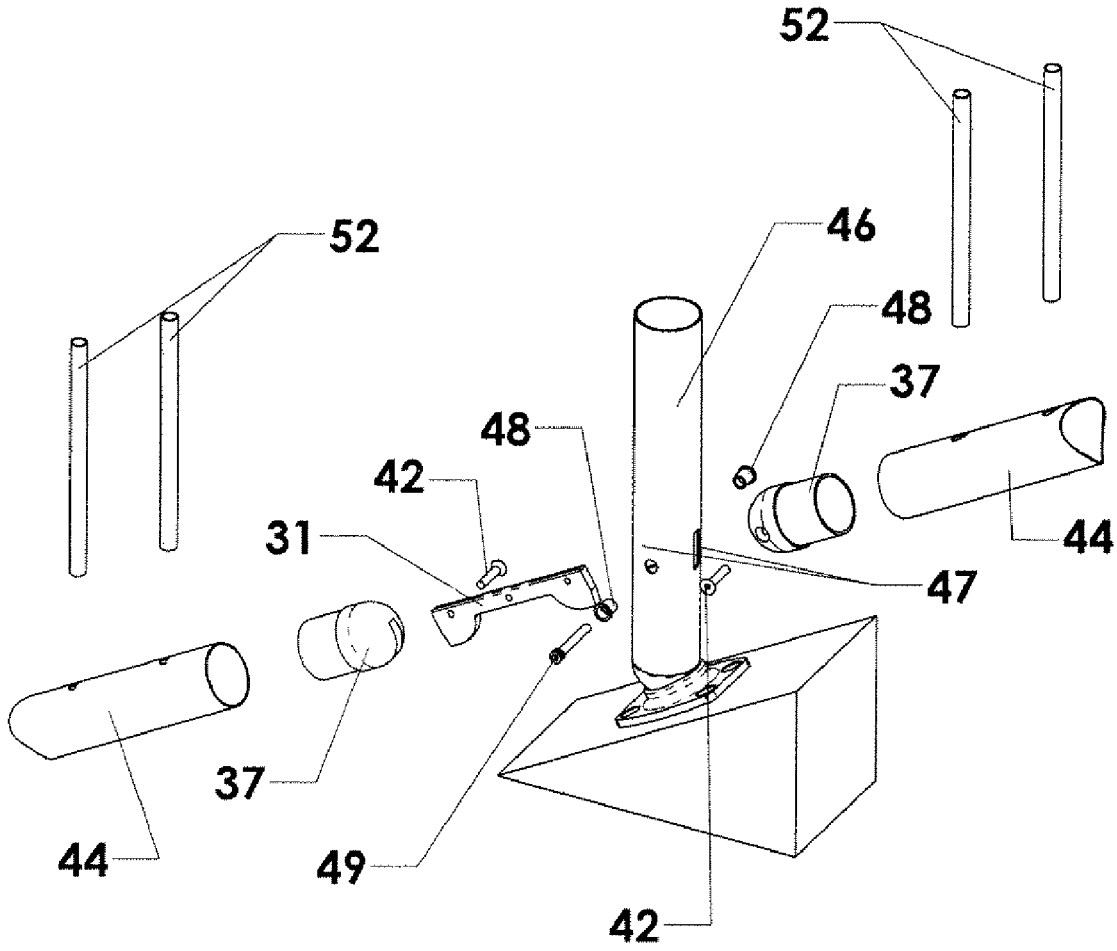
FIG. 5*f* is an exploded, pictorial view of the second toggle bar assembly used in accordance with the system described herein.

FIGS. 5*e* and 5*f* show the various uses of the invention in a stair or ramp system. The invention solves the problem of aligning the bottom rail perfectly with the gradient of the ramp or the stairs, yet still allow complete adaptation to such gradient. Since the fulcrum is located precisely in the center of each vertical post 46 the slope of the bottom rail is uninterrupted by any horizontal attachments to the post, and thus eliminates the manufacture of specially formed and welded adaptors accommodating the various slopes or gradients encountered at such posts 46.

This invention allows a further important benefit to be realized in the construction of ramps and stairs because it permits permanent installations and alignments of all posts 46 first, after which for example a complete sections of balusters 52, contained between a top and a bottom rail can be inserted from the top over the enlarged ends 32, and secured thereto. All now existing stair systems require that one section is built at a time, and therefore no adjustments in alignment are possible.

Figure 6A:
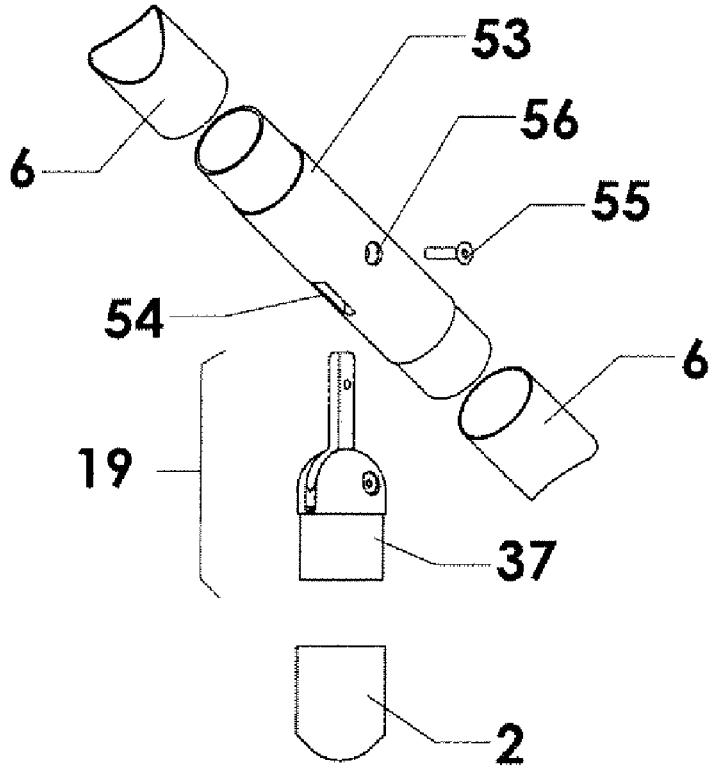
FIG. 6*a* is an exploded, pictorial view of a third toggle bar assembly in accordance with the present invention.
Figure 6B:
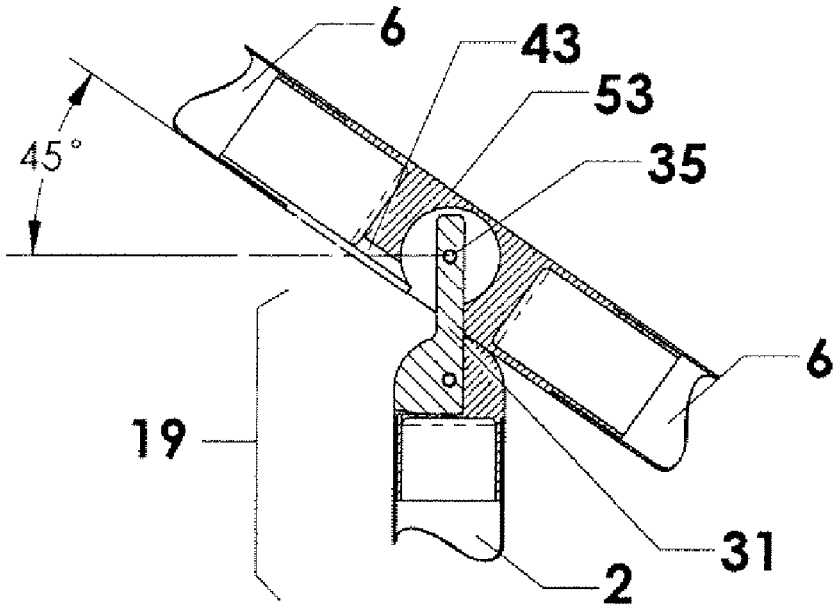
FIG. 6*b* is a cross-section pictorial view of a second toggle bar assembly in accordance with the present invention.

FIGS. 6*a* and 6*b* show a further embodiment of the invention, where 19 is a uniquely shaped toggle bar assembly with only one end, of the type more fully described in FIG. 5*d*, is used in combination with a different "T" fitting 53. In this embodiment the "T" fitting 53 has a slot 54, which allows the end of the specially shaped toggle bar 31 to move from a right angle position up to 45 degrees either side, to adapt to any slope of a ramp or stairs. Once the correct alignment has been achieved, a commercially available bolt 55 is tightened thus locking the "T" fitting in the desired alignment.

A special feature of this further embodiment is that the fulcrum is precisely at the intersection of a post 2 and the top rail 6, and therefore the top and lower rails can be cut to exactly the same length. Since it is desirable not to have the bolt hole 56 being drilled through to the other side of the "T" fitting, a feature of this invention is that hole 56 is not internally threaded, but hole 35 in the specially shaped toggle bar 31 has been threaded to suit bolt 55. When the bolt 55 is tightened, the specially shaped toggle bar 31 is pulled against the inside of the slots 54, which locks the assembly into the desired slope.

Figure 7A:
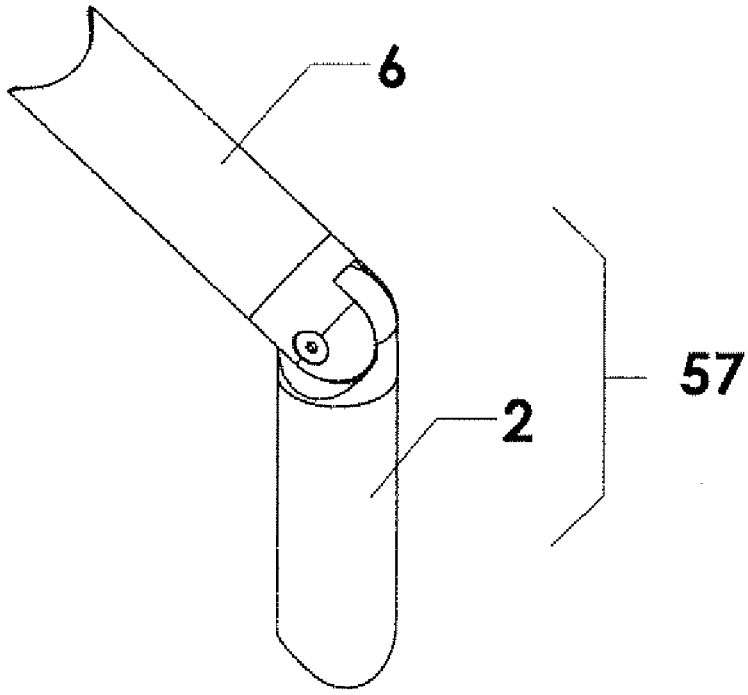
FIG. 7*a* is a pictorial view of a modular, angularly adjustable elbow fitting in accordance with the present invention.
Figure 7B:
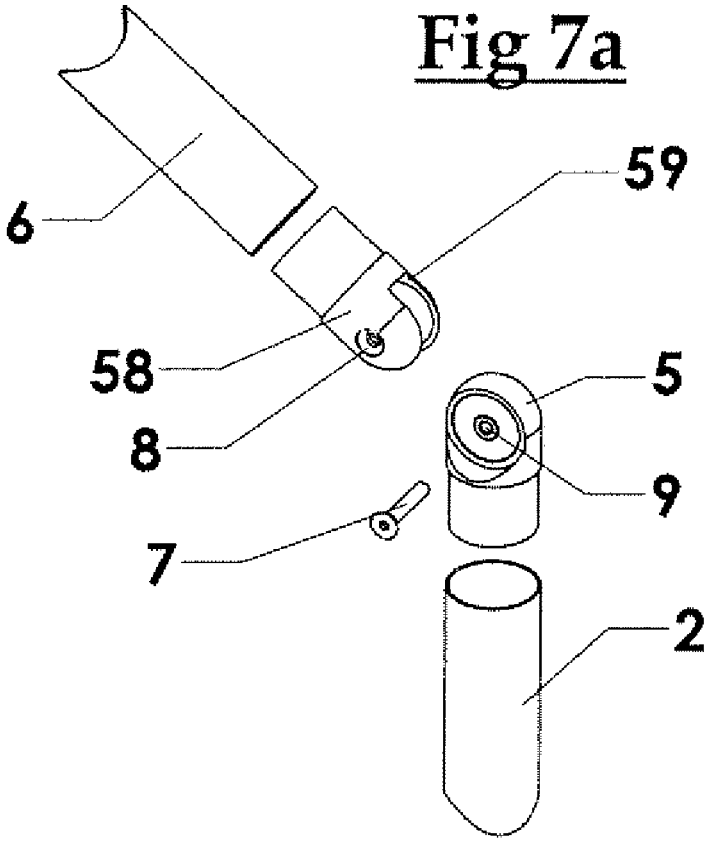
FIG. 7*b* is an exploded, pictorial view of a modular, angularly adjustable elbow fitting in accordance with the present invention.

FIGS. 7*a* and 7*b* illustrate a modular, angularly adjustable elbow fitting 57, typically used at the end of ramps or stairs at the lowest post, which is mounted upon a vertical post or tube 2. Adjustment is effected by use of an end fitting 58 incorporating a clevis 59 shaped so as to receive an adjustable male rail adaptor 5, which is the same part used for the invention described in FIG. 1*a* and 1*b*. The clevis is recessed into the end fitting in such a way as to strengthen the end and have the fulcrum exactly in the center of both intersecting post 2 and top rail 6. After orienting the top rail to the desired slope, which can be from 0 degrees (horizontal) to 50 degrees (as typically encountered on stairways or ramps), a commercially available (or modified for length) connection bolt 7 is tightened, thereby locking the adjustable elbow assembly in place.

Since it is desirable not to have the bolt hole 8 being drilled through to the other side, a feature of this invention is that hole 8 is not internally threaded, but hole 9 in the male rail adaptor 5 has been threaded to suit bolt 7. When the bolt 7 is tightened, the main rail adaptor 5 is pulled against the inside of the clevis 59, which locks the assembly 57 into the desired slope.

Figure 8:
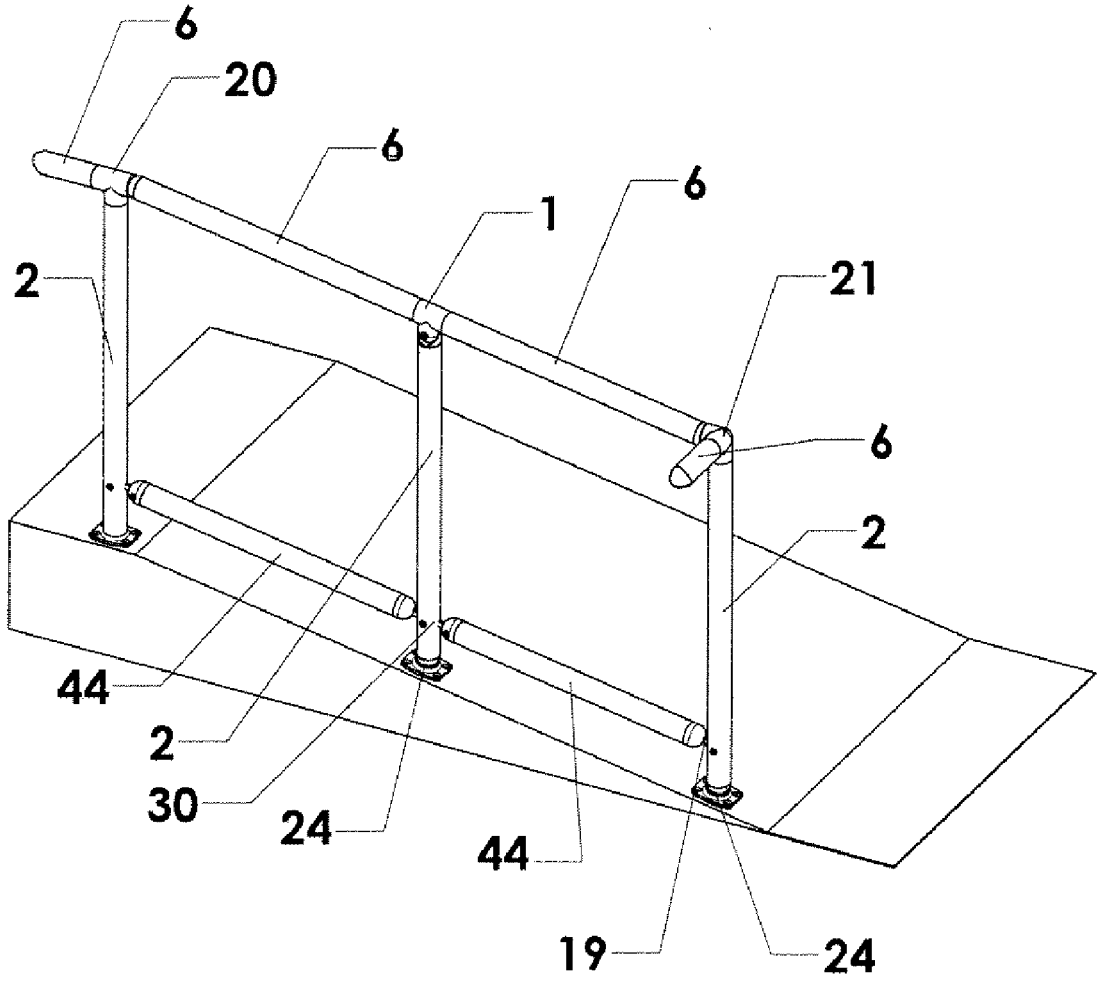
FIG. 8 is a pictorial illustration of a ramp system in accordance with the present invention.

FIG. 8 shows all parts of a ramp system as they would be used in a typical ramp system, and how they would be able to interact with each other Although the invention has been described with respect to various embodiments, it should be realized this invention is also capable of a wide variety of further and other embodiments. For instance the invention could be used in top rails and bottom rails or in combination with other fittings such as the modular, angularly adjustable "T" or corner fittings, or in combination with the modular, angularly adjustable transition "T" or other fittings to form different types, looks and functions of stair and ramp systems. The vertical or horizontal support tubes to which the invention is attached could be solid, cylindrical or rectangular posts, unlike the tubing shown and employed in the present invention. In addition, surfaces which engage each other may be roughened to increase the friction between surfaces and effect better contact therebetween.

What is claimed is:

1. A connector fitting system, comprising:

at least one support member having an end containing a slot and a first blind hole substantially transverse to said slot therein;

a connector bar having at least one end and a portion extending therefrom, said at least one end mountable within said slot;

a threaded fastener element;

said at least one end of said connector bar having a first threaded opening therein to receive said first threaded fastener element therein;

said first threaded fastener element capable of threadably engaging said first threaded opening in said at least one end of said connector bar through said first blind hole in order to secure said connector bar within said slot against an internal surface of said one end of said at least one support member; and said connector bar having a second threaded opening displaced from said first threaded opening in said at least one end of said connector bar, said second threaded opening capable of receiving another threaded fastener element therein such that when said another threaded fastener element is tightened, said connector bar is pulled against the inside of a member for adjustable attachment of the connector bar to the member at a desired slope.

2. The connector fitting system as defined in claim 1 wherein the connector fitting system is an angularly adjustable rail connector fitting system and said at least one support member comprises a rail support member.

3. The connector fitting system as defined in claim 2 further comprises:

a tubular support member, said tubular support member containing a pair of opposed openings therein and a second blind hole in said tubular support member;

said connector bar capable of passing through said pair of openings for adjustable movement with respect to said pair of openings, and said second threaded opening therein capable of being aligned with said second blind hole of said tubular support member;

a second threaded fastener element;

wherein said second threaded fastener element of threadably engaging said second threaded opening in said connector bar in order to secure said connector bar against an internal surface of said tubular support member after adjustment of the connector bar with respect thereto.

4. The connector fitting system as defined in claim 3 further comprising:

a base member having a concave spherical surface, a key located within the concave spherical surface, and a threaded opening within said key;

said tubular support member having a convex spherical surface and a concave spherical surface at an end thereof, said convex spherical surface capable of adjustably engaging said concave spherical surface of said base member, and said convex spherical surface having a slot therein for receiving said key at least partially therethrough;

a fastener mechanism including a threaded fastener element for threadably engaging said threaded opening within said key; and a washer having a spherical convex surface capable of being interposed between said fastener element of said fastener mechanism and said concave spherical surface of said tubular support;

wherein tightening of said fastener element of said fastener mechanism within said threaded opening within said key secures said tubular member to said base member after said tubular member has been angularly adjusted with respect to said base member.

5. The connector fitting system as defined in claim 2 wherein said at least one support member has a weep hole therein.

6. The connector fitting system as defined in claim 2 further wherein said at least one support member comprises a pair of support members, each one of said pair of support members being connected to opposite ends of said connector bar.

7. The connector fitting system as defined in claim 1 further wherein said at least one support member comprises a pair of support members, each one of said pair of support members being connected to opposite ends of said connector bar.

8. The connector fitting system as defined in claim 2 wherein said angularly adjustable rail connector fitting system further comprises:

a tubular support member, said tubular support member containing a first opening therein and a second blind hole in said tubular support member;

said portion extending from said end of said connector bar passing through said first opening, and said portion of said connector bar having said second threaded opening therein capable of being aligned with said second blind hole of said tubular support member;

a second threaded fastener element;

wherein said second threaded fastener element threadably engaging said second threaded opening in said connector bar in order to secure said connector bar against an internal surface of said tubular support member after adjustment of the tubular support member with respect to said connector bar.

9. The connector fitting system as defined in claim 8 further comprising:

a base member having a concave spherical surface, a key located within the concave spherical surface, and a threaded opening within said key;

said support member having a convex spherical surface and a concave spherical surface at an end thereof, said convex spherical surface capable of adjustably engaging said concave spherical surface of said base member, and said convex spherical surface having a slot therein for receiving said key at least partially therethrough;

a fastener mechanism including a threaded fastener element for threadably engaging said threaded opening within said key; and a washer having a spherical convex surface capable of being interposed between said fastener element of said fastener mechanism and said concave spherical surface of said tubular support;

wherein tightening of said fastener element of said fastener mechanism within said threaded opening within said key secures said support member to said base member after said support member has been angularly adjusted with respect to said base member.

* * * * *

UNITED STATES PATENT AND TRADEMARK OFFICE

CERTIFICATE OF CORRECTION

PATENT NO. : 7,540,472 B2
APPLICATION NO. : 11/746943
DATED : June 2, 2009
INVENTOR(S) : Roman F. Striebel et al.

It is certified that error appears in the above-identified patent and that said Letters Patent is hereby corrected as shown below:

Column 7, line 36 (claim 1), "a threaded fastener" should read --a first threaded fastener--

Column 8, lines 2-3 (claim 3), "fastener element of threadably engaging" should read --fastener element threadably engaging--

Signed and Sealed this

Eleventh Day of August, 2009

David J. Kappos

David J. Kappos
*Director of the United States Patent and Trademark Office*